United States Patent [19]

Peterman

[11] Patent Number: 4,569,392

[45] Date of Patent: Feb. 11, 1986

[54] WELL BORE CONTROL LINE WITH SEALED STRENGTH MEMBER

[75] Inventor: Charles P. Peterman, Houston, Tex.

[73] Assignee: Hydril Company, Los Angeles, Calif.

[21] Appl. No.: 480,933

[22] Filed: Mar. 31, 1983

[51] Int. Cl.[4] ..... E21B 17/14; F16L 11/08

[52] U.S. Cl. ..... 166/242; 174/47

[58] Field of Search ..... 166/242, 244 C, 57, 166/65 R; 138/103, 115; 174/47, 74 A, 110 S, 116

[56] References Cited

U.S. PATENT DOCUMENTS

| | | | |
|---|---|---|---|
| 3,236,939 | 2/1966 | Blewis et al. | 174/116 |
| 3,244,800 | 4/1966 | McLaughlin et al. | 174/110 S |
| 3,847,183 | 11/1974 | Meyer | 174/74 A X |
| 3,915,888 | 10/1975 | Hoeppel | 174/23 C X |
| 3,992,570 | 11/1976 | Beinhaur | 174/74 A X |
| 4,024,913 | 5/1977 | Grable | 166/242 X |
| 4,196,464 | 4/1980 | Russell | 174/47 X |
| 4,262,703 | 4/1981 | Moore et al. | 174/47 X |
| 4,440,974 | 4/1984 | Naudet | 174/110 S X |

*Primary Examiner*—Stephen J. Novosad
*Assistant Examiner*—Thuy M. Bui
*Attorney, Agent, or Firm*—Dodge, Bush & Moseley

[57] ABSTRACT

A flexible control line for communication in a well bore is disclosed having a communication tube and a strength member extending along the tube. The tube and strength member are encapsulated in a sheath of elastomeric material. Sealing means are provided for the strength member to prevent fluid or gas migration to the surface through the strength member from a subsurface source.

15 Claims, 6 Drawing Figures

FIG. 1
PRIOR ART
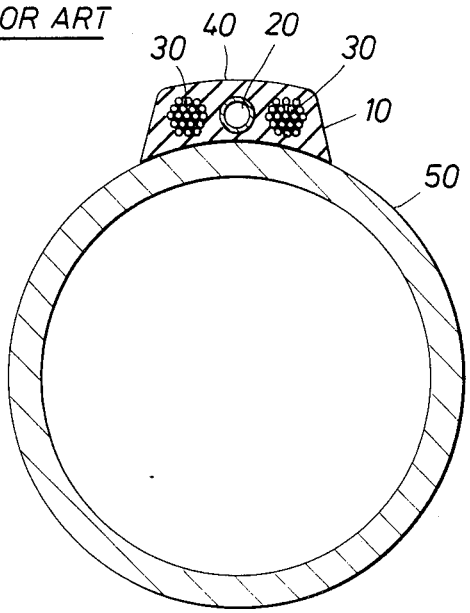
FIG. 2
PRIOR ART
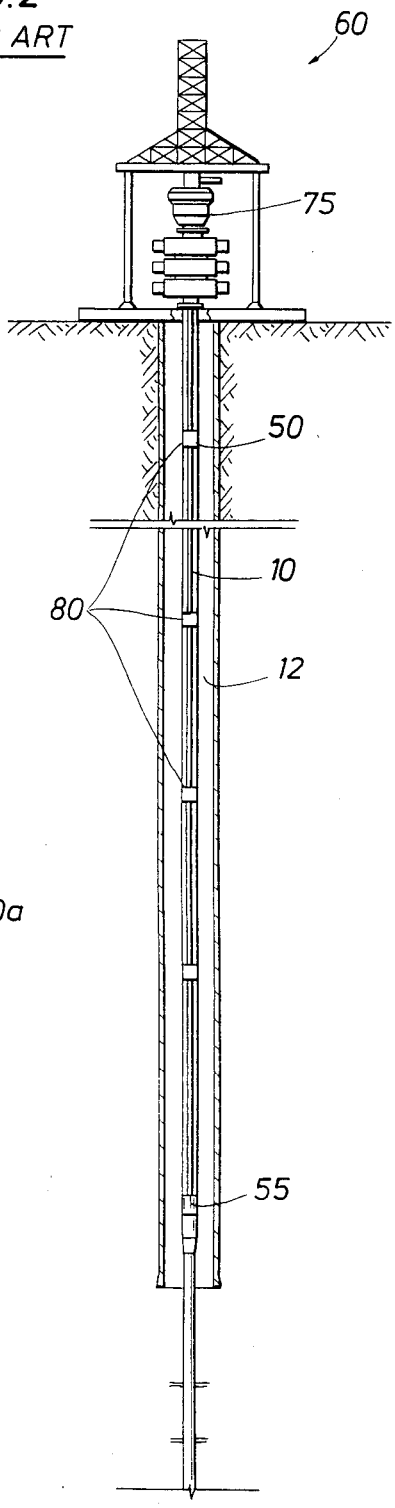
FIG. 3
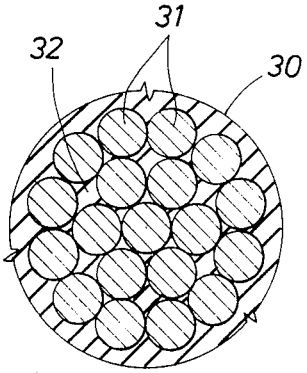
FIG. 4
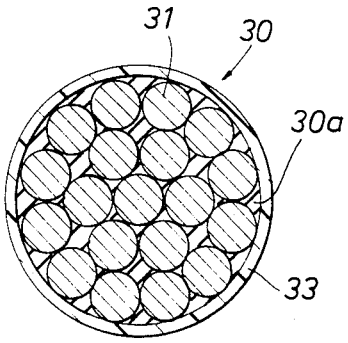
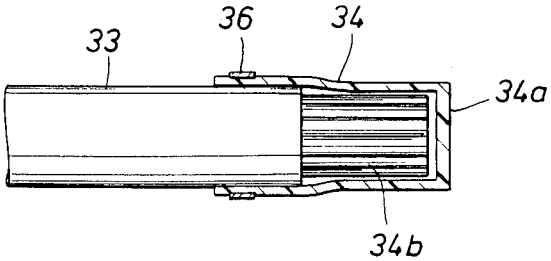
FIG. 5
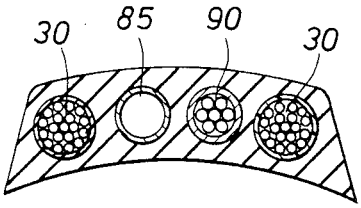
FIG. 6

WELL BORE CONTROL LINE WITH SEALED STRENGTH MEMBER

BACKGROUND OF THE INVENTION

1. Field of the Invention

The field of the invention relates to control and injection lines for use in the oil and gas industry. When used as a control line the invention has application to the operation of subsurface valves used in oil or gas producing well bores. Such lines also find application to downhole chemical injection systems for corrosion protection. The lines also find application for use as blowout preventer control lines, instrument package deployment cables, etc.

2. Description of the Prior Art

U.S. Pat. No. 3,844,345, issued in the names of Evans and Newman, discloses encapsulated control tubes in a sheath of elastomeric material so that the encapsulated control lines may be easily handled and fit against production tubing. The encapsulated control line of U.S. Pat. No. 3,844,345 is designed specifically to control subsurface control valves via the fluid control tubes in the encapsulated control lines. Its shape is such that a surface blowout preventer may advantageously completely seal the annular space about the production tubing and the control line fit against it.

U.S. Pat. No. 4,262,703 issued in the names of Moore and Kendall shows a control line for attachment to an underwater oil or gas flow line for attachment to a downhole tubing string or for control in subsea workover operations. The control line of this patent includes two tension-bearing members such as wire ropes and includes hydraulic tubes and electrical and electronic lines encapsulated in a resilient elongated body.

Similar kinds of encapsulated control lines are used for injecting corrosion inhibiters in downhole chemical injection systems. For this application, one or more wire ropes are provided which extend generally along one or more control lines. The control lines and wire ropes are encapsulated in an elastomeric sheath in the same fashion as are those of U.S. Pat. No. 3,844,345.

As indicated above, the encapsulated control or flow lines of U.S. Pat. No. 3,844,345 are especially adapted to be secured to production tubing which extends through a surface disposed blowout preventer during that phase of completing an oil or gas well of positioning the production tubing in the well. After the tubing is secured in place in the well, the blowout preventer is removed and a production "Christmas tree" is placed at the surface of the well to safely control high pressure gas or oil flowing from the well.

During the time that the tubing and the attached flow lines extend through the blowout preventer, high pressure conditions in the well are controlled by closing the blowout preventer, thereby closing the vertical flow path of the well which surrounds the tubing and flow lines. Since the strength or anti-crushing member of the control or flow line may be open to pressurized fluid or gas in the well, there has existed the possibility that high pressure fluid or gas could migrate to the surface past the blowout preventer via the voids or interstices in the strength or anti-crushing member in the flow line, even though the blowout preventer completely seals the vertical flow path about the outside of the production tubing and attached control or flow line.

SUMMARY OF THE INVENTION

It is therefore an object of this invention to provide a control or flow line which, when secured to tubing and extending into a well through a blowout preventer, prevents the possibility of high pressure gas or fluid below the blowout preventer from migrating via voids in the strength or anti-crushing members to the surface above the blowout preventer.

It is a further object of this invention to provide a control or flow line having one or more strength members in which high pressure fluid or gas at one end of the flow line is prevented from migrating via the strength member to the other end.

BRIEF DESCRIPTION OF THE DRAWINGS

The preferred embodiments of this invention will be described hereafter together with other features thereof and additional objects will become evident from such description.

The invention will be more readily understood from the following specification and by reference to the accompanying drawings forming a part thereof wherein an example of the invention is shown and wherein:

FIG. 1 is a cross-sectional view of an encapsulated control line with two strength members as it is attached to production tubing;

FIG. 2 is a schematic representation of a well in which production tubing extends through a blowout preventer stack showing a flexible control line attached to a downhole chemical injection device and being clamped to the production tubing;

FIG. 3 is a preferred embodiment of the invention showing a cross-section of a strength member;

FIG. 4 is an alternative preferred embodiment of a strength member according to the invention;

FIG. 5 shows a way of terminating the end of the strength member as shown in FIG. 4; and FIG. 6 represents a cross-section of a flexible control line having two strength members and two communication paths for communicating between the surface and downhole apparatus.

DESCRIPTION OF THE INVENTION

FIG. 1 shows a prior art encapsulated control line 10 having a communication tube 20 and two wire rope strength members 30 encapsulated in a sheath of elastomeric material 40 which may be any suitable material such as polyethylene, polyurethane, polyvinylchloride, etc. Control line 10 is adapted to be secured with pipe 50 which represents production tubing in a producing oil or gas well.

FIG. 2 shows one application of the control line 10 as it is secured to a production tubing 50 in an oil well shown generally at 60. The control line 10 may advantageously be used as shown in FIG. 2 for connecting a chemical injection pump and tank (not illustrated) to a chemical injection device 55 in an oil or gas well 60. Control line 10 is typically clamped to production tubing extending through one or more blowout preventers 75 during the time when tubing is being placed in the well. After the tubing is in place and the well is completed, the blowout preventers 75 are removed and a production Christmas tree is secured to the wellhead in a manner well known. In the application shown in FIG. 2, a producing oil well may need injection of chemicals via the chemical injection device 55 in order to inhibit corrosion and possibly paraffin, scale, salt, and defoaming agents in the well. Typically, the control line is attached to the tubing by one or more clamps 80.

Where such control lines are secured with production tubing during the placing of the well through a blowout preventer 75, the problem of migration via the control line exists because high pressure fluid or gas during a kick in the well may migrate to the surface via the strength member 30 of control line 10, even though the blowout preventer 75 (especially an annular blowout preventer) effectively seals the annulus 12 of the well about the tubing 50 and attached control line 10. Even when the blowout preventer has been removed, the chemical injection device 55 and the end of control line 10 may be subject to high pressure fluid or gas. Thus, where the control line is used in a producing well, the high pressure fluid or gas may migrate to the surface via the control line strength member. For these reasons, there has existed a problem of sealing such strength members against pressurized gas or fluid.

FIG. 3 shows a preferred embodiment for sealing such strength member 30. Strength member 30 may be a wire rope, nylon rope, common hemp, graphite strands, etc., depending on the particular application for control line 10. The preferred embodiment of FIG. 3 provides a blocking medium such that each strand 31 of a wire rope 30 is substantially embedded in a material 32 such as a silicone-based blocking compound, similar to Dow-Corning RTV 732, or a thixotropic lubricating compound like Dow-Corning DC 111. Such compounds can be used to fill or block a tension member such as a wire rope during cabling operation of the wire.

Alternatively, the wire rope interstices may be filled by pressure extruding a polyolefin or a rubber-based resin as a separate manufacturing operation prior to encapsulation in control line 10.

After the wire rope material has been embedded in a sealing material as per FIG. 3, it is placed in a sheath of elastomeric material in the construction such as the prior art FIG. 1 or in FIG. 6 to be described in more detail below.

One alternative embodiment of the invention exists where the entire bundle of strands of the strength members are jacketed or sheathed in a material which preferably may be an extruded polyolefin or a rubber-based resin.

A second alternative embodiment of the invention is shown in FIG. 4 where, in addition to the outer jacket 33 mentioned for the first alternative embodiment, the wire rope or other material of strength member 30 is embedded in a sealing material 30 or similar to that described above and shown in FIG. 3.

FIG. 5 shows how the alternative embodiments or the embodiment of FIG. 3 may be terminated at the end which extends into the well by providing end jacketing material 34 such as extruded polyolefin or a rubber-based resin to cover any exposed wire rope material both at its end 34*a* and along an exposed section 34*b*. Such end sealing means over the exposed section of the strength member may be clamped as per clamp 36 which seals the end jacket 34 to the exterior sheath jacket 33 over the strength member.

FIG. 6 shows a control line having two control tubes 85 and 90 and strength members 30. Strength members 30 are provided according to the invention with sealing means either according to the embodiment shown in FIG. 3 or the first and second alternative embodiments of the invention. Control tube 85 may be a stainless steel tube of 0.020 inch wall thickness (Passivated Trent Tube Spec 116-3c). Other sizes and other wall thicknesses may of course advantageously be used. Additionally, a control tube 90 may be a coaxial cable or alternatively, a conventional electrical cable comprising insulated electrical leads. Such electrical cable advantageously should be sealed or blocked in a manner similar to that described above by which the strength member is sealed. An electrical cable sheathed in metal tubing may also be provided for control tube 90.

It is apparent that there has been provided in accordance with the invention described here, a well bore control line with a sealed strength member which overcomes the disadvantages of the control lines previously provided. While the invention has been described in conjunction with specific embodiments thereof, it is evident that many alternatives, modifications and variations would be apparent to those skilled in the art in light of the foregoing description. Accordingly, it is intended to embrace all such alternatives, modifications and variations that fall within the spirit and scope of the appended claims.

What is claimed is:

1. A control line for communication in a well bore comprising:

a control tube for communication between surface and subsurface apparatus;

a strength or anti-crushing member extending along said control tube having means to prevent pressurized fluid from migrating from a subsurface source to a surface end of said strength member; and a sheath of elastomeric material substantially encapsulating said control tube and said strength member.

2. The control line of claim 1 wherein said strength or anti-crushing member is nylon rope.

3. The control line of claim 1 wherein said strength or anti-crushing member is wire rope.

4. The control line of claim 2 wherein said means to prevent fluid or gas from migrating through said wire rope comprises sealing means in which said wire rope is substantially embedded.

5. The control line of claim 4 wherein said sealing means is a silicone-based blocking compound.

6. The control line of claim 4 wherein said sealing means is a thixotropic lubricating compound.

7. The control line of claim 4 wherein said sealing means comprises:

jacketing means for surrounding said wire rope along its length; and terminating means for sealing the subsurface end of said wire rope.

8. The control line of claim 7 wherein said jacketing means and said terminating means comprise polyolefin resin material.

9. The control line of claim 7 wherein said jacketing means and said terminating means comprise rubber-based resin material.

10. The control line of claim 2 wherein said means to prevent fluid or gas from migrating through said wire rope comprises sealing means including;

means for substantially embedding said wire rope;

jacketing means for surrounding said wire rope along its length; and terminating means for sealing the subsurface end of said wire rope.

11. The control line of claim 2 wherein said control line is an electrical communication path.

12. The control line of claim 11 wherein said electrical communication path is an electrical cable having means to prevent pressurized fluid or gas from migrating from a subsurface source to the surface end of said electrical communication path.

13. The control line of claim 11 wherein said electrical communication path is an electrical cable sheathed in a metallic tube.

14. A control line for communication in a well bore comprising:

a control tube for communication between surface and subsurface apparatus;

a strength or anti-crushing member extending along said control tube having means to prevent pressurized fluid from migrating from a subsurface source to a surface end of said strength member;

a sheath of elastomeric material substantially encapsulating said control tube and said strength member;

wherein said strength or anti-crushing member is a wire rope; and wherein said control line is a tube for supplying corrosion inhibiting chemicals to downhole apparatus.

15. In a control line adapted for attachment to well tubing extending through a blowout preventer into a well and having a control tube for communication between surface and subsurface apparatus, a strength or anti-crushing member extending along said control tube, and a sheath of elastomeric material substantially encapsulating said control tube and said strength or anti-crushing member and having an arcuate shape forming an inner surface for mounting against said well tubing and a generally convex outer surface for providing a sealing element about said control tube and said strength or anti-crushing member where an annular seal is substantially effected with the well tubing by a blowout preventer to prevent escape of well fluids adjacent the control lines, wherein the improvement comprises blocking means about said strength or anti-crushing member to prevent pressurized well fluid from migrating from a subsurface source to a surface end of the strength member, whereby, on closure of said blowout preventer about said well tubing and the control line attached to the well tubing, pressurized well fluid is prevented from escape from the well about the outside of the control line by virtue of said generally convex outer surface of the sheath of elastomeric material, and pressurized well fluid is prevented from the escape from the well via the strength or anti-crushing member by said blocking means.

* * * * *